US005778578A

United States Patent [19]

Drapcho et al.

[11] Patent Number: 5,778,578

[45] Date of Patent: Jul. 14, 1998

[54] VIEW-CHANGING DISPLAY

[76] Inventors: Joseph E. Drapcho, 24 West Lake St.; Gregory M. Proulx, 40 West Lake St., both of Waconia, Minn. 56387

[21] Appl. No.: 625,575

[22] Filed: Mar. 28, 1996

[51] Int. Cl.[6] ..... G09F 11/00

[52] U.S. Cl. ..... 40/491; 40/124.09; 116/321; 446/151

[58] Field of Search ..... 40/124.01, 124.09, 40/124.14, 486, 488, 491; 116/321, 322, 323; 446/149, 151, 152

[56] References Cited

U.S. PATENT DOCUMENTS

| | | | |
|---|---|---|---|
| D. 159,974 | 9/1950 | Garrett . | |
| D. 203,011 | 11/1965 | Heller et al. . | |
| D. 317,623 | 6/1991 | Piechocki | D19/1 |
| D. 322,808 | 12/1991 | Piechocki | D19/1 |
| 956,916 | 5/1910 | Wiederseim . | |
| 1,603,592 | 10/1926 | Glasner . | |
| 1,658,968 | 2/1928 | Carroll | 40/488 |
| 1,975,446 | 10/1934 | Cahn . | |
| 2,083,912 | 6/1937 | Johntz . | |
| 2,145,794 | 1/1939 | Huber | 40/491 X |
| 2,367,967 | 1/1945 | Schwartz . | |
| 2,377,346 | 6/1945 | Horr | 40/491 X |
| 2,377,414 | 6/1945 | Gold | 40/491 X |
| 2,884,724 | 5/1959 | Lohnes . | |
| 3,946,508 | 3/1976 | Booras . | |
| 4,349,973 | 9/1982 | Penick . | |
| 4,586,279 | 5/1986 | Hopkins . | |
| 4,763,427 | 8/1988 | Schrager . | |
| 4,774,780 | 10/1988 | Crowell . | |
| 4,913,694 | 4/1990 | Alphenaar | 493/356 |
| 5,112,298 | 5/1992 | Hibsch | 493/325 |
| 5,141,253 | 8/1992 | Rice | 283/65 |
| 5,450,680 | 9/1995 | Bromberg | 40/491 X |

OTHER PUBLICATIONS

"The Winning Combination," Schaper Mfr. Co., P.O. Box 1426, Mpls., MN 55440, 1986 Catalog.

*Primary Examiner*—Brian K. Green
*Attorney, Agent, or Firm*—Larry M. Jennings, P.A.

[57] ABSTRACT

A view-changing display is made from one generally rectangular sheet of resilient planar material having a first side and a second side. At least one viewing window, graspable tab and slot through which the tab may slide are formed in the sheet, preferably by die cutting. The sheet is divided into a front panel, at least one sliding panel ending with a graspable tab, a biasing element preferably comprised of a resilient panel disposed between the front panel and each sliding panel, and an optional back panel preferably extending from the front panel opposite the biasing element. The second side of the sliding panel is folded to face the second side of the biasing element. The second side of the front panel is then folded to face the first side of the sliding panel and to mate the tab and slot. The second side of the optional back panel may be folded to face the first side of the biasing element. The display view is changed by pulling the tab which bows the biasing element and displaces the sliding panel. This displacement of the sliding panel brings a section of it that was previously covered by the front panel into alignment with the viewing window to display a changed view comprised of printed matter, a photograph, any small thin object or other visible feature. When the tab is released, the biasing element relaxes, immediately returning the sliding panel to its original position and restoring the original view. Multiple sliding panels and corresponding biasing elements may be provided.

27 Claims, 4 Drawing Sheets

VIEW-CHANGING DISPLAY

FIELD OF THE INVENTION

The present invention relates to the fields of manually-activated, self-return mechanisms and to view-changing displays generally, and to momentary-action type view-changing displays made of planar or sheet materials in particular. Greeting cards, especially those characterized as "surprise," "pop-up," "pop-out," "pull-tab" or "reveal" cards, are among the familiar applications for view-changing displays, some of which are quite elaborate. View-changing displays may also be incorporated into folders, books, advertisements, brochures, promotional articles, novelties, games, toys, amusements, and the like, as well as in equation-solving devices, charts, maps, educational materials, tables and other useful articles. Many applications for the present invention include the momentary presentation of a visible sensory event. However, the invention may be used to momentarily present other sensory stimulation and is not limited to the presentation of visual stimulation.

Apparatus in the field of the present invention are often made of folded material although other techniques of fabrication can readily be used without departing from the invention. Although low cost and workability with existing methods and equipment make paper a favored material for view-changing displays, other materials may provide utilitarian, aesthetic or manufacturing advantages. Some view-changing displays can be printed, scored, die-cut, folded, glued, assembled and packaged using conventional printing presses. Other view-changing displays can be made of natural or synthetic sheet materials other than paper such as metals, plastics and wood. Likewise, any of the cutting, hinging, folding, springing, assembling, operating or other manufacturing steps may be performed manually.

The changing views available make the present display useful as a training aid or reference source. Concealed instructions or answers corresponding to questions displayed by the normal view of the invention may be momentarily revealed by pulling the tab. The present display could enable a student to reveal only the answer to a specific question when desired. Learning is often enhanced if students receive immediate feedback regarding their efforts.

Designers, illustrators and writers may use this view-changing display to create greeting cards and gifts having much greater sophistication and delightfulness than conventional greeting cards at a nominal increase to production costs. It is anticipated that this view-changing display will be used to display photographs, among other things, particularly photographs of children. It may also be used for entertainment, play and games that involve concealment and revelation of images, text or other perceptible features. Apparatus in the field of the invention may also be used in advertising, children's books, education, greeting cards, promotions and as novelties or amusements.

BACKGROUND OF THE INVENTION

View-changing displays and methods for their manufacture have long been the subject of inventive effort. The usual purpose for making a view-changing display is to present an article having greater sensory appeal than would be possible with a non-changing display. Generally, view-changing displays, including the present invention, are fabricated from paper; however, many sheet materials can be used to make such displays including, without limitation, vinyl, polyethylene, other polymers, resins, resin-coated paper, treated paper, leather, parchment, foil, leaf, laminae, textile, metal, and wood materials. View-changing displays in the field of the present invention often are purposefully designed to allow them to be mailed readily. Upon opening the display, the recipient may be presented with animation, a changing message, a surprise image, or a dimensionality that is unavailable in conventional greeting cards and displays.

View-changing displays in great variety have been used as greeting cards, advertising materials, toys, and the like. Two types of active elements are most commonly used to effect display change: either the "pop-up/pop-out" type or else the "slide/pull-out" type. Many examples of pop-up view-changing displays are known, including the fanciful *Greeting Card* described by Schrager in U.S. Pat. No. 4,774,780. Crowell's *Bent Resilient Leaf Spring Pop-up Display Assemblies* shown in U.S. Pat. No. 4,763,427 teaches a self-erecting pop-up stationery display that is comprised of a parallelogram or "Z-shaped" resilient leaf spring element bonded to a greeting card or other display medium.

Penick, et al. discloses *Pop-ups and Methods of Making* in U.S. Pat. No. 4,349,973, but the pop-up element requires the addition of adhesive both in the fabrication of the pop-up portion and also to affix the pop-up element to the card.

Another approach to the addition of motion, novelty and surprise to displays, greeting cards and similar articles is the addition of a working or moving element that may be operated by the observer to create a different view. Among previous view-changing displays of the sliding type are a variety of pull cards and sliding cards designed to amuse and stimulate the interest of people who view them.

Huber received U.S. Pat. No. 2,145,794 for a *Greeting Card* having a folded sheet that can be extended longitudinally by unfolding it to make an elongated display and also extend a second, relatively narrow element. Huber did not suggest a simple way to return the card to its original configuration.

Cahn described a *Display Card* in U.S. Pat. No. 1,975,446 that included an operable printed strip that could slide behind a front panel that displayed an image of a person's face. A window cut in place of the mouth of the visage depicted on the front panel allowed an observer to read text as the printed strip was moved across the window opening. Like Huber, Cahn did not disclose a biasing element for returning the display to the original view.

In U.S. Pat. No. 4,586,279, for example, Hopkins discloses a *Folding Display Assembly* that a person can activate to cause animation. The Hopkins apparatus allows a panel that has images of eyes and mouth to move behind a humorous illustration of a humorous face that has cut-outs through which the moving eyes and mouth may be viewed.

Likewise, U.S. Pat. No. 3,946,508 issued to Booras for a *Scene-changing Display Card* comprised of windowed envelope surrounding a sliding element. A deflectable lower portion of the apparatus is affixed to the sliding element with adhesive. When the lower portion is deflected, the portion of the sliding element that is normally exposed by the envelope window moves out of view and a different, normally concealed, section of the slide is revealed through the window.

Both Booras and Hopkins appear to rely on resilient or spring-like properties of portions of the sheet material from which their inventions are fabricated to return the sliding elements from displaced positions to the original positions. The resiliency of the operating elements present in both articles is limited because sections of the sheet material must be sharply folded during fabrication.

It is also to be noted that many of the earlier devices require cutting complex shapes from the sheet material which makes the manufacture of the display more difficult. For example, the Booras device and the Hopkins device both require an "L" shaped sheet as the starting material. Although other shapes can be used satisfactorily, the starting material for the present invention is preferably rectangular and the cutting needed is generally straight and quite simple which can reduce material, set-up, tooling, production and re-work costs compared to other displays known in the art.

SUMMARY OF THE INVENTION

Although considerable effort has been expended in the field of view-changing displays, operable greeting cards, holiday scenes, and ornamentation, the efforts have, until now, failed to produce a view-changing display having sufficient intricacy and potentially diverse modes of implementation to stimulate people's fascination while, at the same time, being susceptible to manufacture at a relatively modest cost.

The present invention is a slide-type view-changing display in that the normal view is visible until an optional, secondary or changed view is presented. Pulling a tab moves a sliding panel that is situated behind a front panel in which one or more viewing apertures or windows are formed. As the sliding panel moves from its original position to its secondary position, features on the sliding panel that were visible in the normal view are moved away from the front panel viewing windows and obscured. Simultaneously, different features slide into view behind the front panel viewing windows, thereby revealing the optional, momentarily revealed, view, for convenience referred to as the momentary view. When the tab is released, the sliding panel automatically returns to its original position in response to the spring action of a biasing element, preferably a resilient panel.

The biasing element of the present view-changing display is preferably, though not necessarily, comprised of a resilient panel or section formed from the same sheet as are the other elements of the invention. The elongated resilient panel retains "springiness" or "memory" better than do the bent or folded elements previously disclosed by other workers. This uniquely effective design makes it possible to manufacture view-changing displays at modest cost that have longer expected useful lifetimes than would similar articles made according to previously known designs.

This view-changing display also offers advantages over previous articles and methods even for applications in which longer useful life of the product is not particularly important, such as in advertising or editorial materials included with printed publications. The present view-changing display is easily fabricated from a single piece of sheet material such as paper that is both foldable and also somewhat resilient. Other sheet materials such as steel foil, may also be used to make the view-changing display according to the invention. If it is desired to make the invention from material that is not foldable or which will not retain a fold, hinge elements may optionally be provided.

Not only is the view-changing display preferably made from a web or single sheet, it may also remain a single sheet after fabrication is completed. The fact that the article is made from and remains a single sheet can be important to advertisers and publishers of magazines and other printed publications. Second-Class Mail is a highly favorable postage rate made available by the U.S. Postal Service for distribution of published materials that meet certain strictly enforced criteria. An issue of a publication that violates second-class mail restrictions, perhaps by including a non-conforming advertising insert, would require the publisher to pay significantly higher third-class postage rates for those copies. A factor that can be important in meeting second-class mailing restrictions is whether certain items such as advertising or subscription inserts, reply cards and supplements are formed from a single sheet.

Low production costs may be realized because the design is easily fabricated using existing machinery. In addition, the design may preferably be manufactured without using any adhesives, which eliminates all costs for purchasing and using a material frequently included in previously known contributions to the art.

A method of making this view-changing display from a generally rectangular sheet of resilient planar material having a first side and a second side comprises the steps of cutting therein at least one viewing window, graspable tab, and slot through which the tab may slide, preferably by die cutting. The sheet is divided by folding it to form a front panel having the viewing window, at least one sliding panel ending with a graspable tab, a biasing element, preferably comprised of a resilient panel disposed between the front panel and each sliding panel, and an optional back panel preferably extending from the front panel opposite the biasing element. The second side of the sliding panel is folded to face the second side of the biasing element. The second side of the front panel is then folded to face the first side of the sliding panel and to mate the tab and slot. The second side of the optional back panel may be folded to face the first side of the biasing element.

A preferred method for changing the display view comprises the steps of grasping the view-changing display with one hand on the side of the front panel opposite the tab, grasping the tab with the thumb and forefinger of the other hand, and pulling the tab through the slot, thereby displacing the sliding panel and causing the biasing element to bow. This displacement of the sliding panel brings a section of it that was previously covered by the front panel into alignment with the viewing window to display a changed view comprised of printed matter, a photograph, illustration or other thin object. Releasing the tab restores the original view by allowing the biasing element to straighten and immediately return the sliding panel to its original position.

Multiple sliding panels and corresponding biasing elements may be provided. It is anticipated that such multiple sliding panels would be preferred in many applications. It is to be understood that the multiple resilient biasing elements and sliding panels could be cut from the same sheet as the rest of the display during a once-through press operation in which indicia may be printed onto a sheet or web, viewing windows cut, tabs cut, slots cut through which the tabs may slide, slots cut to subdivide the sliding panel and biasing element into a plurality of separately operable panels, and the sheet folded into an operable configuration as shown in the appended drawings. The sheet may also have slits formed in the sliding panels, other thin objects. Similarly, the apparatus may be fitted with adhesives, holders, or other means for attaching objects.

It is likely that printed matter and photographs may be attached to the sliding panels of the present invention. However, the invention may be used to stimulate other sensory responses and is not limited to the presentation of visual stimulation. Examples of items other than text and printed matter that could be attached to the sliding panel for presentation to an observer include scientific specimens (e.g., minerals), materials, sounds, textures, scents and colors. Moveable or other operative contact between materials affixed to the sliding panel and materials affixed to the back surface of the front panel may be employed to produce a desired sound or to release a scent. Information that is paired, or associated, with other discrete elements can be taught using the present invention as a teaching aid. For example, the normal view could display the name of a state, and the momentarily revealed portion of the sliding panel could display the capitol of the state. The mechanism of the present invention may also be used in recreational games and various types of gaming and wagering.

Any number of actuating, linking or movement displacing elements may be added to the basic elements illustrated in the appended drawing without departing from the scope of the invention. For example, a strip of planar material could be affixed to one of a multiplicity of sliding panels at an angled orientation relative so that pulling on an upper tab would reveal an alternative momentary view at a lower portion of the front panel. It is further to be understood that the action of the tabs may be linked so that pulling on a particular tab may actuate one or more of the other, independently operable tab and sliding panel assemblies.

DETAILED DESCRIPTION OF THE DRAWING AND BEST MODE FOR CARRYING OUT THE INVENTION

The present invention as well as its objects and advantages can be illustrated by describing the fabrication, structural elements, characteristics and functional elements of the preferred embodiments as shown on the attached drawing.

Figure 6:
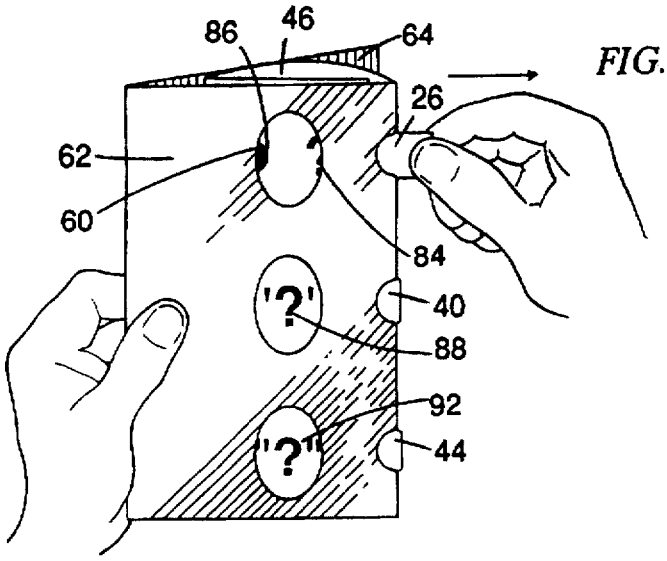
FIG. 6 is a perspective view of the embodiment of the invention shown in FIG. 5 wherein one sliding panel is operationally disposed to bow the biasing element and partially reveal the momentary view.
Figure 7:
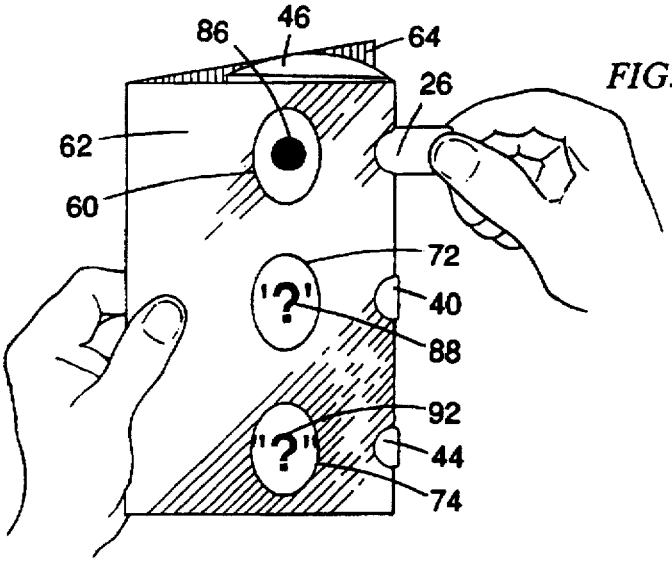
FIG. 7 is a perspective view of the embodiment of the invention shown in FIG. 6 wherein one sliding panel is operationally disposed to fully reveal the momentary view.
Figure 8:
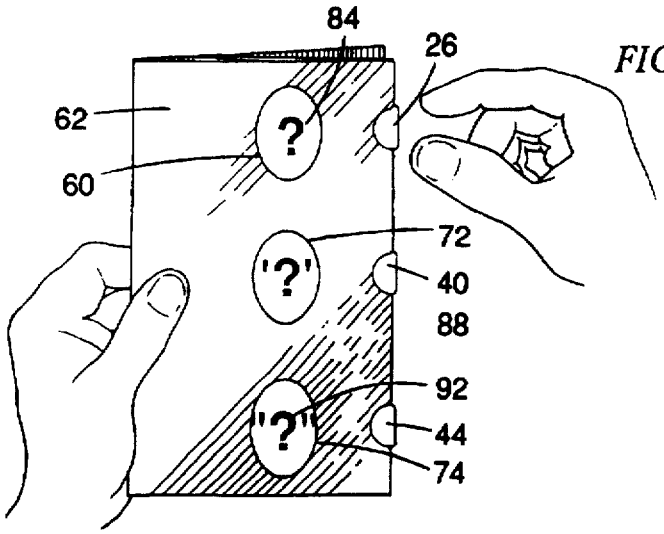
FIG. 8 is a perspective view of the embodiment of the invention shown in FIG. 7 wherein the tab has been released and the sliding panel returned to the normal position or view by the action of the biasing element.

Referring to the drawing, and initially to FIGS. 1–8, a view-changing display and method for its fabrication will be described. The steps for forming a preferred embodiment are depicted FIGS. 1–5. Operation of the embodiment is depicted in FIGS. 6–8. A second preferred embodiment and its operation are shown in FIGS. 9–12.

Figure 1:
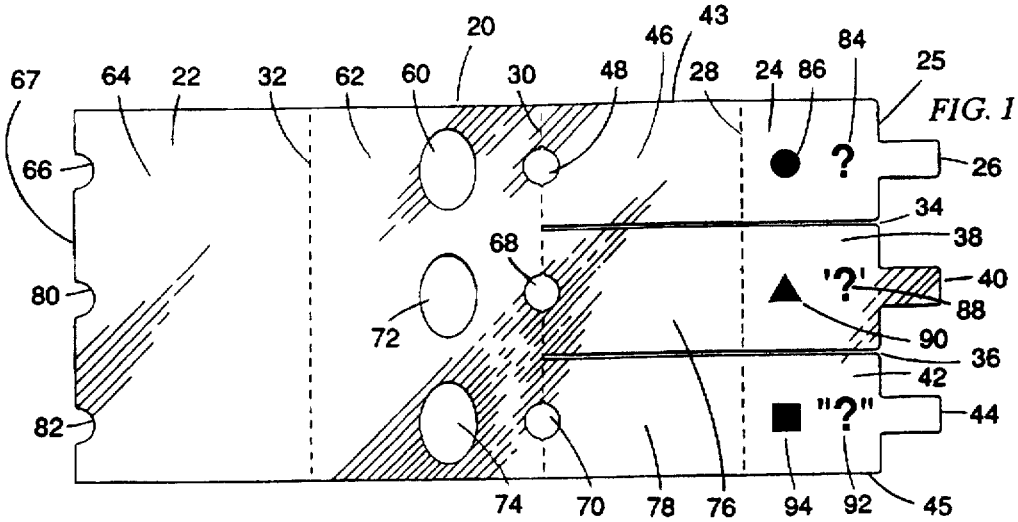
FIG. 1 is a plan view of the first side of the cut out resilient sheet material blank from which one embodiment of the view-hanging display is constructed.

Referring to FIG. 1, a method of fabricating the view-changing display 20 includes the fabrication of a sheet, which may be printed or coated, preferably a good quality resilient heavy paper such as 60 pound or 100 pound stock into a blank which will be denominated resilient sheet 22. Other weights and thicknesses, both heavier and lighter, can be used to fabricate the view-changing display 20 depending on the desired lifetime of the completed product, its size, and the composition of the resilient sheet 22. It is to be emphasized that the resilient sheet 22 of the present invention can be fabricated from almost any planar material or lamina that is either resilient or to which biasing elements and/or hinging elements may be attached including, without limitation, polymers, resins, resin coated paper, treated paper, leather, parchment, leaf, foil, laminae, textile, metal, wood and other materials that may become available, henceforth. The resilient sheet material 22 may be printed, cut, and folded using conventional printing techniques and equipment. The display may also be fabricated using techniques and equipment ranging from simple manual methods to advanced fully automated production methods that process either single sheet or continuous roll feed material.

A first sliding panel 24 is formed at the first end 25 of the resilient sheet 22. A first graspable portion, or tab 26, extends from the first sliding panel 24 opposite the first fold 28. A second fold 30 and a third fold 32 are formed generally parallel to the first fold 28 and first end 25 of the resilient sheet 22, preferably with scoring prior to folding thereby defining the sections or panels of the apparatus. A first slot 34 oriented generally perpendicular to the second fold 30 extends from the first end of the resilient sheet 22 to the second fold 30. A second slot 36 oriented generally perpendicular to the first slot 34 likewise extends from the second fold 30 to the first end 25 of the resilient sheet 22 thereby defining a second sliding panel 38 from the end of which a second tab 40 extends opposite from the first fold 28.

The first sliding panel 24, the second sliding panel 38 and a third sliding panel 42 are defined inwardly in their bi-directionally slidable axes by the first fold 28 and outwardly by the first end 25 of the resilient sheet 22. With respect to its bi-directionally slidable axis, the lateral dimension of the first sliding panel 24 is defined by the top 43 and the first slot 34. With respect to its bi-directionally slidable axis, the lateral dimension of the second sliding panel 38 is defined by the first slot 34 and the second slot 36. With respect to its bi-directionally slidable axis, the lateral dimension of the third sliding panel 42 from which tab 44 extends opposite the first fold 28 is defined by the second slot 36 and the bottom 45 of resilient sheet 22.

One end of a first biasing element 46 is separated by fold 28 from the adjacent first sliding panel 24. The other end of the first biasing element 46 is defined by fold 30 through which is formed a first tab passageway 48.

An aperture comprising a first viewing window 60 is cut through the front panel 62. The front panel 62 is defined as the portion of resilient sheet 22 bounded by the top 43, the bottom 45, the second fold 30, and the third fold 32.

An optional, though preferable, back flap 64 may extend from the front panel 62 in a direction opposite the second fold 30. A tab notch 66 may be cut from the back flap 64 at the second end 67 of the resilient sheet 22 to make the tab 26 easier to grasp when the view-changing display 20 is operated.

A second tab passageway 68 is cut through the resilient sheet 22 at a point along the second fold 30 in alignment with the second tab 40 so that the second tab 40 may be operably extended. Likewise, the third tab passageway 70 is cut through the resilient sheet 22 at a point along the second fold 30 in alignment with the third tab 44 so that the third tab 44 may be operably extended.

Apertures comprising a second viewing window 72 and a third viewing window 74 are cut through the front panel 62 at locations selected to reveal the normal views and the momentary views presented by the second sliding panel 38 and the third sliding panel 42, respectively.

A second biasing element 76 and a third biasing element 78 correspond with the second sliding panel 38 and the third sliding panel 42, respectively, and, like the first biasing element 46, extend from the first fold 28 to the second fold 30. It is to be understood that any generally resilient material may be used to automatically restore the view-changing display to the view that existed prior to operation of the sliding panels.

A second tab notch 80 and a third tab notch 82 may be cut from the optional back flap 64 at the second end 67 of the resilient sheet 22 so as to align with the second tab passageway 68 and the third tab passageway 70, respectively.

As used herein, the term "feature" or "features" includes the ordinary meaning of the term, including, without limitation, illustrations, images, colors, figures, forms, text, other perceptible objects, and sensory stimuli. Features comprising a first normally revealed view 84 and a first momentarily revealed view 86 are symbolically represented as affixed to the first sliding panel 24.

Features comprising a second normally revealed view 88 and a second momentarily revealed view 90 are symbolically represented as affixed to the second sliding panel 38.

Features comprising a third normally revealed view 92 and a third momentarily revealed view 94 are symbolically represented as affixed to the third sliding panel 42.

Figure 2:
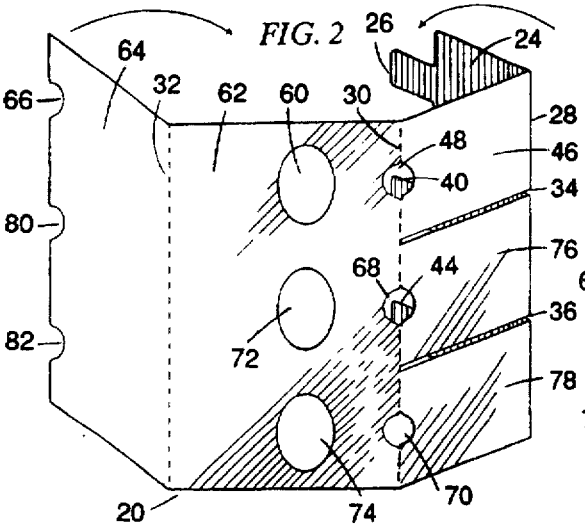
FIG. 2 is a perspective view of the partially folded blank of FIG. 1 showing a portion of the second side of the blank, identified by vertical shading lines.

Referring now to FIG. 2, the sliding panels 24 38 42 are shown bent on fold line 28 relative to the biasing elements 46 76 78.

Figure 3:
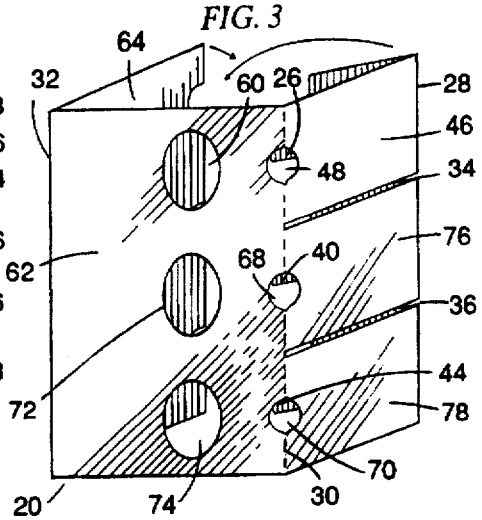
FIG. 3 is a perspective view of the partially folded blank shown in FIG. 2 at a further stage of completion.

FIG. 3 shows an advanced stage of the folding of the sliding panels 24 38 42 along fold line 28 relative to the biasing elements 46 76 78.

Figure 4:
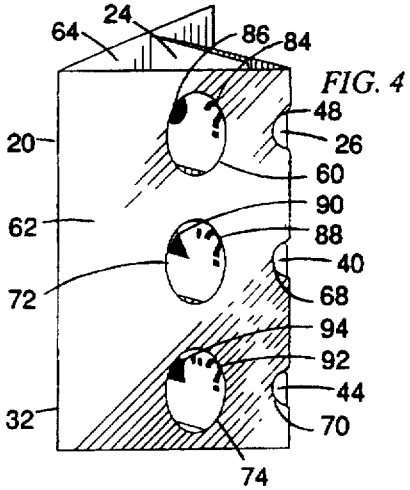
FIG. 4 is a perspective view of the partially folded blank shown in FIG. 3 at a further stage of completion.

FIG. 4 shows the completed folds on fold line 28 of the sliding panels 24 38 42 toward the biasing elements 46 76 78 thereby fitting the tabs 26 40 44 into the tab passageways 48 68 70. It can be seen that the fold on fold line 30 must be completed before completing the fold on fold line 32.

Figure 5:
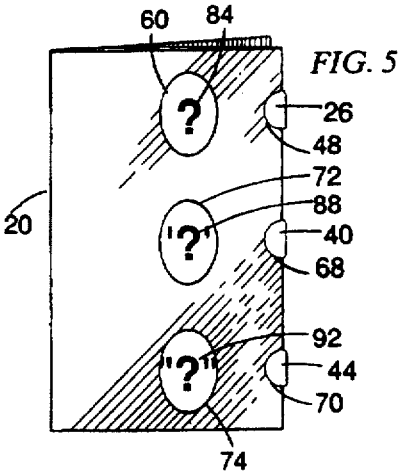
FIG. 5 is a perspective view of the completely folded blank shown in FIG. 4 wherein each sliding panel is situated in the normal position or view.

FIG. 5 shows the completed view-changing display 20 in its normal view.

FIG. 6 shows an embodiment of the view-changing display 20 in the grasp of an observer. The first tab 26 is partially extended causing the first biasing element 46 to bow or otherwise deflect. The extension of the first tab 26 through the first tab passageway 48 has displaced the first sliding panel 24 along its bidirectional axis of movement thereby partially obscuring the first normally revealed view 84 behind the front panel 62. It can also be seen that the first momentary view 86 is partially visible through the first viewing window 60.

FIG. 7 shows the first tab 26 in its fully extended condition thereby completely revealing the first momentary view 86 at the first viewing window 60. Additional deflection or bowing of first biasing element 46 can also be seen.

FIG. 8 shows the view-changing display 20 after the observer has released the grasp of the first tab 26 from the thumb and forefinger thereby allowing the first biasing element 64 to relax and return the first sliding panel 24 to its original position which results in the display of the first normally revealed view 84.

Figure 9:
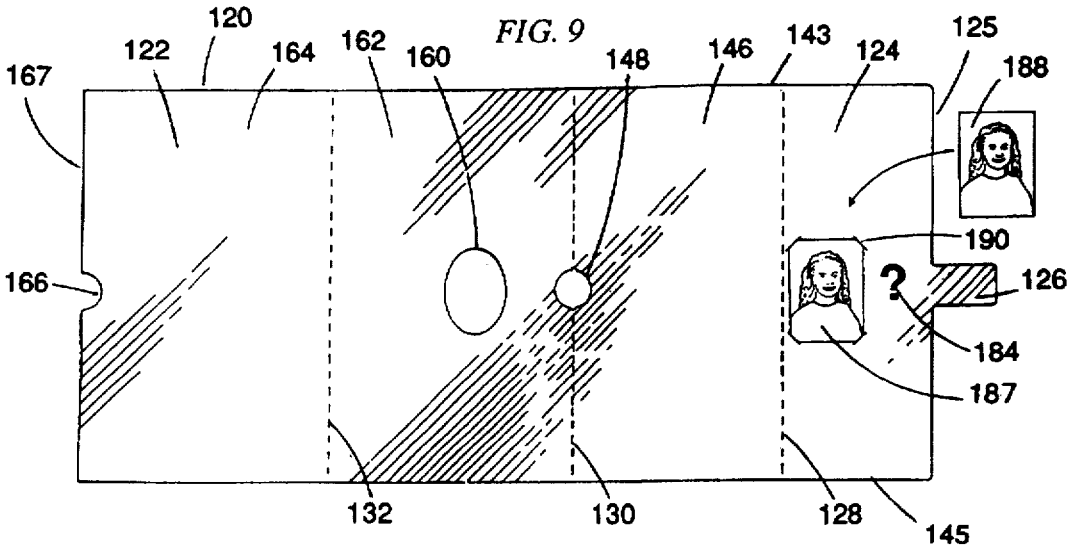
FIG. 9 is a plan view of the cut out resilient sheet material from which another embodiment of the view-changing display is constructed and which shows means for attaching a photograph or other feature and indicia symbolic of the printing or other ornamentation that may be applied to the present invention.

FIG. 9 shows a second, simpler, embodiment of a view-changing display 120 that is adapted for easily receiving thin objects such as photographs.

A sliding panel 124 is formed at the first end 125 of the resilient sheet 122. A graspable portion, or tab, 126 extends from the sliding panel 124 opposite the first fold 128. A second fold 130 and a third fold 132 are formed generally parallel to the first fold 128 and first end 125 of the resilient sheet 122, preferably with scoring prior to folding thereby defining the sections or panels of the apparatus.

The sliding panel 124, is defined inwardly in its bi-directionally slidable axis by the first fold 128 and outwardly by the first end 125 of the resilient sheet 122. With respect to its bi-directionally slidable axis, the lateral dimension of the sliding panel 124 is defined by the top 143 and the bottom 145 of the resilient sheet 122.

One end of the biasing element 146 is separated by fold 128 from the adjacent sliding panel 124. The other end of the biasing element 146 is defined by second fold 30 through which is formed a tab passageway 148.

An aperture comprising a first viewing window 160 is cut through the front panel 162. The front panel 162 is defined as the portion of resilient sheet 122 bounded by the top 143, the bottom 145, the second fold 30, and the third fold 32.

An optional, though preferable, back flap 164 may extend from the front panel 162 in a direction opposite the second fold 30. A tab notch 166 may be cut from the back flap 164 at the second end 167 of the resilient sheet 122 to make the tab 126 easier to grasp when the view-changing display 120 is operated.

Features comprising a first normally revealed view 184 and a first momentarily revealed view 186 are symbolically represented as affixed to the sliding panel 124. A receivable object location 187 for receiving a photograph or other feature 188 may be created on the sliding panel by the formation of receiving slits 190 or other attachment means such as adhesives, envelopes, tapes, fasteners, and the like.

Figure 10:
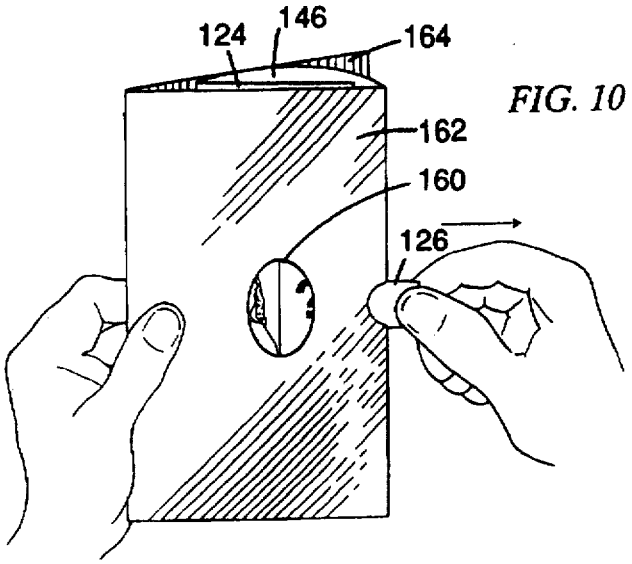
FIG. 10 is a perspective view of the folded embodiment of the invention shown in FIG. 9 wherein the sliding panel is operationally disposed to deflect the biasing element and partially reveal the momentary view.

FIG. 10 shows an embodiment of the view-changing display 120 in the grasp of an observer. The tab 126 is partially extended causing the biasing element 146 to bow or otherwise deflect. The extension of the tab 126 through the tab passageway 148 has displaced the sliding panel 124 along its bidirectional axis of movement thereby partially obscuring the normally revealed view 184 behind the front panel 162. It can also be seen that the momentary view 186 is partially visible through the viewing window 160.

Figure 11:
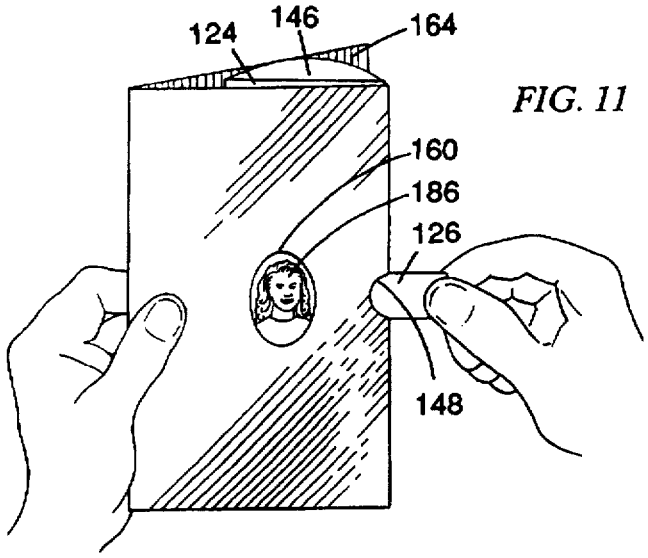
FIG. 11 is a perspective view of the embodiment of the invention shown in FIG. 10 wherein the sliding panel is operationally disposed to fully reveal the momentary view.

FIG. 11 shows the tab 126 in its fully extended position thereby completely revealing the momentary view 186 at the first viewing window 60. Additional deflection or bowing of biasing element 146 can also be seen.

Figure 12:
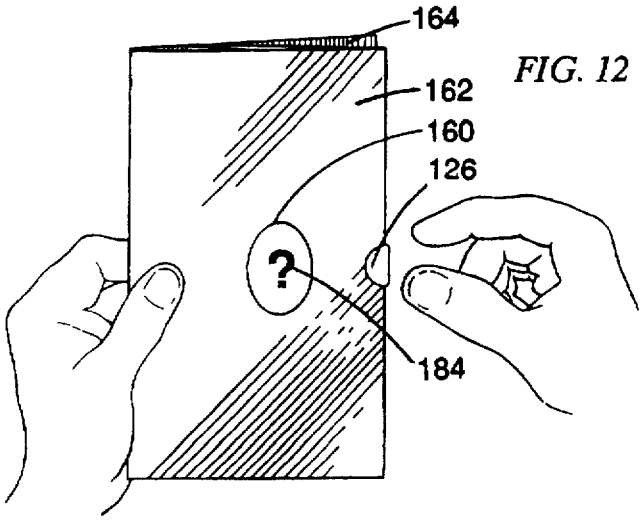
FIG. 12 is a perspective view of the embodiment of the invention shown in FIG. 11 wherein the tab has been released and the sliding panel has returned to the normal position or view by the action of the biasing element.

FIG. 12 shows the view-changing display 120 after the observer has released the tab 126 from the grasp of thumb and forefinger thereby allowing the biasing element 164 to relax and return the sliding panel 124 to its original position which results in display of the normally revealed view 184.

It is to be emphasized that the number of intermediate sliding panels like the second sliding panel 38 is limited only by the constraints of manufacture and use. Although the resilient sheet 22 is shown as having greater width than height prior to folding, the dimensions and orientation of the resilient sheet 22 may be modified in any desired manner without departing from the disclosure of the invention. Likewise, the tabs 26 40 44 and sliding panels 24 38 42 may operate in any direction and may be situated on the horizontal, the vertical and angled axes, and may be situated on more than one edge or peripheral region of the resilient sheet 22 in alternative embodiments that may be desired from time to time.

Changes and modifications in the specifically described embodiments can be carried out without departing from the scope of the invention which is intended to be limited only by the scope of the appended claims.

What is claimed is:

1. A view-changing display comprising:

a generally rectangular foldable resilient sheet having a first end from which a tab extends and a second end;

a first fold generally perpendicular to a direction said tab extends from said foldable sheet, a sliding panel between said first end and said first fold that includes said tab, said sliding panel provided with a first and a second set of observable indicia;

a biasing element between said first fold and a second fold spaced apart from and generally parallel to said first fold;

a front panel between said second fold and a third fold spaced apart from and generally parallel to said second fold;

a back flap between said third fold and said second end;

a tab passageway formed on said second fold, said tab passageway aligned in correspondence with said tab; and a viewing window formed in said front panel;

the resilient sheet is folded to form the view-changing display, the sliding panel is layered between the front panel and the biasing element, the biasing element is layered between the sliding panel and the back flap, and the tab is accessible through the tab passageway; and the first set of indicia is observable through the viewing window, and when the tab is urged outward from the folded view-changing display, the second set of indicia is observable through the viewing window.

2. The view-changing display as defined in claim 1 further comprising a tab notch formed in said back flap corresponding to said tab passageway.

3. The view-changing display as defined in claim 2 further comprising:

means for attaching a first feature at a location on said sliding panel viewable through said viewing window when said biasing element is in a relaxed state, means for attaching a second feature at a location on said sliding panel adjacent said first feature so as to be viewable through said viewing window when bias of said biasing element is overcome by manually urging said tab through said tab passageway.

4. The view-changing display defined in claim 3 wherein said means for attaching said second feature is comprised of slots through said resilient sheet, said slots oriented and adapted for holdably receiving a photograph.

5. The view-changing display defined in claim 4 further comprised of a plurality of viewing windows.

6. The view-changing display as defined in claim 3 wherein said slidable panel and said biasing element are formed by folding a single resilient sheet.

7. The view-changing display defined in claim 6 further comprised of a plurality of viewing windows.

8. The view-changing display defined in claim 3 further comprised of a plurality of viewing windows.

9. The view-changing display defined in claim 3 further comprising:

a plurality of tabs extending from said first end of said resilient sheet, a slot through said resilient sheet between said tabs, said slot extending perpendicularly from said second fold to said first end thereby defining a multiplicity of sliding panels and corresponding biasing elements, a plurality of tab passageways formed on said second fold in correspondence with said tabs, a viewing window corresponding to each of said sliding panels.

10. The view-changing display defined in claim 9 wherein said resilient sheet includes a polymerized resin.

11. The view-changing display defined in claim 9 wherein said resilient sheet includes a metallic component.

12. The view-changing display defined in claim 9 wherein said resilient sheet is comprised of a composite material.

13. The view-changing display defined in claim 9 wherein said resilient sheet is comprised of paper.

14. The view-changing display defined in claim 9 further comprising a plurality of tab notches formed in said back flap, each of said notches corresponding to one of said tab passageways.

15. The view-changing display defined in claim 14 wherein said resilient sheet is comprised of paper.

16. The view-changing display defined in claim 15 wherein said sliding panels bear printed markings.

17. The view-changing display defined in claim 15 wherein said front panel bears printed markings.

18. The view-changing display defined in claim 14 wherein said sliding panels bear printed markings.

19. The view-changing display defined in claim 18 wherein said front panel bears printed markings.

20. The view-changing display defined in claim 14 wherein said front panel bears printed markings.

21. The view-changing display defined in claim 1 wherein the resilient sheet includes a polymerized resin.

22. The view-changing display defined in claim 1 wherein the resilient sheet includes a metallic component.

23. The view-changing display defined in claim 1 wherein the resilient sheet is comprised of a composite material.

24. The view-changing display defined in claim 1 wherein the resilient sheet is comprised of paper.

25. A view-changing display comprising:

a generally rectangular foldable resilient sheet having a first end from which a tab extends and a second end;

a first fold generally perpendicular to a direction the tab extends from the foldable sheet, a sliding panel between the first end and the first fold;

a biasing element between the first fold and a second fold spaced apart from and generally parallel to the first fold and a front panel between the second fold and a third fold spaced apart from and generally parallel to the second fold, a back flap between the third fold and the second end, a tab passageway formed on the second fold, the tab passageway aligned in correspondence with the tab, a viewing window formed in the front panel, and slots on the sliding panel oriented and adapted for holdably receiving a feature so as to be viewable through the viewing window when bias of the biasing element is overcome by manually urging the tab outward through the tab passageway.

26. A view-changing display comprising:

a generally rectangular foldable resilient sheet having a first end from which a tab extends and a second end;

a first fold generally perpendicular to a direction said tab extends from said foldable sheet, a sliding panel between said first end and said first fold that includes said tab, said sliding panel provided with a first and a second set of observable indicia;

a biasing element between said first fold and a second fold spaced apart from and generally parallel to said first fold;

a front panel between said second fold and a third fold spaced apart from and generally parallel to said second fold;

a back flap between said third fold and said second end;

a tab passageway formed on said second fold, said tab passageway aligned in correspondence with said tab;

a viewing window formed in said front panel; and a tab notch formed in said back flap corresponding to said tab passageway.

27. A view-changing display according to claim 26, the resilient sheet is folded to form the view-changing display, the sliding panel is layered between the front panel and the biasing element, the biasing element is layered between the sliding panel and the back flap, and the tab is accessible through the tab passageway.

* * * * *